US006230810B1

(12) United States Patent
Rivas

(10) Patent No.: US 6,230,810 B1
(45) Date of Patent: May 15, 2001

(54) METHOD AND APPARATUS FOR PRODUCING WELLBORE FLUIDS FROM A PLURALITY OF WELLS

(75) Inventor: Olegario S. Rivas, Bartlesville, OK (US)

(73) Assignee: Camco International, Inc., Houston, TX (US)

( * ) Notice: Subject to any disclaimer, the term of this patent is extended or adjusted under 35 U.S.C. 154(b) by 0 days.

(21) Appl. No.: 09/301,414

(22) Filed: Apr. 28, 1999

(51) Int. Cl.[7] ..... E21B 29/12

(52) U.S. Cl. ..... 166/357; 166/68.5; 166/105.5; 166/366

(58) Field of Search ..... 166/52, 68.5, 105.5, 166/357, 366

(56) References Cited

U.S. PATENT DOCUMENTS 4,848,475 * 7/1989 Dean et al. ..... 166/357
4,900,433 * 2/1990 Dean et al. ..... 210/170
6,004,385 * 12/1999 Birmingham ..... 96/174
6,036,749 * 3/2000 Ribeiro et al. ..... 95/261
6,080,312 * 6/2000 Bowers et al. ..... 210/512.2

* cited by examiner

*Primary Examiner*—Roger Schoeppel
(74) *Attorney, Agent, or Firm*—Fletcher, Yoder & Van Someren

(57) ABSTRACT

A technique is described for producing fluids from a series of wells. Production fluids from production wells are raised from the wells and deposited in a collection well. The production fluids may include both liquid and gas phase components. The collection well may serve to permit separation of the gas and liquid phase components under the forces of gravity. The fluids deposited in the collection well are separately displaced to a further collection and processing location. The head requirements for the pumping systems of the production wells is reduced by the need only to transmit the production fluids to the collection well. A pumping system in the collection well then produces some or all of the deposited fluids. Where the fluids include significant quantities of gas, the collection well pumping system may only produce the liquid-phase components, reducing the capacity requirements for the collection well pumping system.

28 Claims, 5 Drawing Sheets

METHOD AND APPARATUS FOR PRODUCING WELLBORE FLUIDS FROM A PLURALITY OF WELLS

BACKGROUND OF THE INVENTION

1. Field of the Invention

The present invention relates generally to the field of systems for producing minerals such as oil and gas from geological formations via subterranean wells. More particularly, the invention relates to a technique for producing flowable minerals by extracting fluids from one or more wells and depositing the fluids in a gathering or collection well where the fluids may separate and be subsequently pumped to a collection or processing point.

2. Description of the Related Art

A wide range of completion techniques have been devised and are presently in use for producing useful flowable minerals, such as oil and gas, from subterranean deposits. In production wells having sufficient natural pressure to force the fluids to a collection point, typically at the earth's surface, the wells may be exploited directly without artificial pumping means. Where, however, the well pressures are insufficient for this purpose, various types of pumps are employed to raise the fluids to the earth's surface. These pumps may be located at least partially above the earth's surface, with pumping elements or rods extending to the location of the fluid. However, in many applications, it is preferable to use a submersible pumping system deployed in the well and driven electrically to displace the wellbore fluids under sufficient pressure to convey them to the collection or processing point.

In many pumping systems used to extract petroleum and similar products from production wells, the production rate may be hampered by the presence of fluids of lesser interest, or by elevations through which the fluids must be raised. Specifically, in many petroleum wells, liquid phase components of wellbore fluids are mixed or disbursed with gaseous phase components. Separators may be employed to at least partially extract the gaseous phase components for production of the petroleum, or the liquid and gas may be allowed to gravity separate, where the dispersion permits. However, such techniques may not always present the most economical solution from the point of view of actual production rates. Accordingly, wellbore fluids may be raised to the earth's surface and stored in a gathering station, typically an above-ground container, where gas-phase components are allowed to slowly migrate from the liquid-phase components.

While such collection stations are generally effective for separating the wellbore fluid components from one another, they are not without drawbacks. For example, depending upon the well production volume and collection schedules, the collection stations may occupy significant real estate. Also, such collection stations are not generally permitted or desirable in environmentally sensitive areas, near residential areas, and so forth.

In addition to problems associated with separation of wellbore fluid components, production from groups of wells having mixed gas and liquid components is often limited by the head required to raise the fluids to the collection point. Specifically, because the production rate of fluid typically declines with the head required to force the fluids from the well to the collection point, where a collection point is more distant or raised with respect to the well head, the production rate from the pumping system declines, in cases quite significantly. This is particularly problematic in wells that are located some distance from the collecting station, and in sub-sea wells from which production fluids must be raised to an elevated production vessel or a platform, or to a distant collection point.

There is a need, therefore, for an improved technique for producing fluids from production wells which provides both efficient production rates and which allows separation of wellbore fluid components. Moreover, there is a need for a technique which can be applied in a wide variety of environments, including with one or more land-based wells, with sub-sea wells, wells in environmentally sensitive areas, and the like.

SUMMARY OF THE INVENTION

The present invention provides a novel technique for producing wellbore fluids designed to respond to these needs. The technique makes use of a collection or gathering well in conjunction with one or more production wells. Fluid produced from the production wells is discharged or injected into the collection well from which they can be subsequently pumped. The collection well provides significant volume for the storage of the production fluids, offering extended residence time for the separation of wellbore fluids, where desired. The wellbore fluids may be separated in the collection well under gravity, or the separation may be augmented by the use of mechanical separating devices. The production rates from the production wells is enhanced by the reduced need to extract one wellbore fluid component from the other. Moreover, production rates may be greatly enhanced by the provision of pumping systems in the production wells which may operate at efficient production levels due to the reduced head offered by the proximity and elevation of the collection well. The collection well may be drilled expressly for the purpose of collecting the wellbore fluids, or may include one or more abandoned or otherwise economically less attractive wells in the neighborhood of the production wells.

BRIEF DESCRIPTION OF THE DRAWINGS

The foregoing and other advantages of the invention will become apparent upon reading the following detailed description and upon reference to the drawings in which.

DETAILED DESCRIPTION OF SPECIFIC EMBODIMENTS

Figure 1:
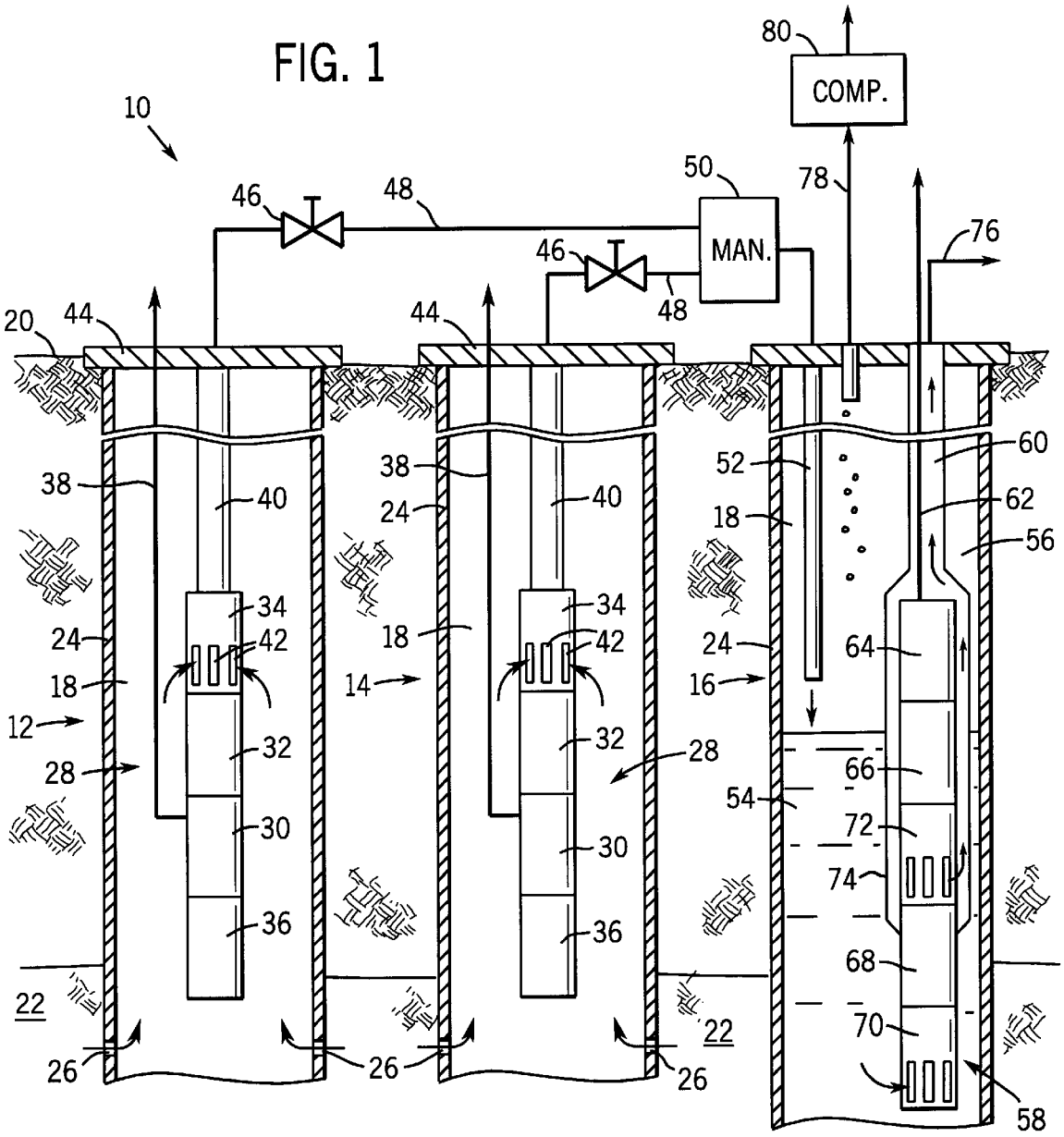
FIG. 1 is an elevational view of a series of production wells equipped to produce fluids and deposit the fluids into a collection well in accordance with the present technique.

Turning now to the drawings and referring first to FIG. 1, a system, designated generally by the reference numeral 10, is illustrated for producing fluid minerals of interest from a series of subterranean wells. As illustrated, the system provides for production from a pair of wells, including a production well 12 and a second production well 14, which may be part of a field of wells. Fluids from the wells are raised from their collection point within the respective wells, and deposited within a collection well 16. It should be noted that, while in the present description reference is made to a pair of production wells which deposit fluid into a single collection well, in practice, as few as a single production well may be included in the system, along with a single collection well. However, in appropriate applications, many production wells may be grouped into the system and produce fluids which may be collected in one or more collection wells. Similarly, production may be continuous or intermittent from one or more of the production wells in the system.

Each of the wells of the system forms a wellbore 18 which traverses a series of subterranean geological formations. The wellbores 18 extend from the earth's surface 20, with the production wells 12 and 14 traversing at least one production formation as indicated at reference numeral 22. The wellbores are lined with a casing 24 to provide structural integrity. In production wells 12 and 14, production perforations 26 are formed adjacent to production formation 22 to permit fluids from the formation to enter into the wells. It should be noted that where the production wells are fairly close to one another, the production formation may be essentially the same. However, the present technique is not limited to wells positioned in the same production formation, but may be employed in wells extending through separate or interlinked subterranean production formations. It should also be noted that while in the present description reference is made to generally vertical wellbores, the present technique may be employed in wells having a variety of orientations and configurations, including inclined or horizontal sections, one or more production horizons, as well as horizons for the production of specific minerals such as oil or gas, and horizons for the injection of specific fluids, such as water or gas.

In the embodiment illustrated in FIG. 1, fluids are produced from production wells 12 and 14 by submersible pumping systems 28. Where one or more of the production wells provides sufficient pressure to produce fluids to the desired elevation, such pumping systems may not be necessary. However, in general, a pump is provided for raising the production fluids to a convenient height, typically at or slightly above the level of the earth's surface 20.

The pumping systems 28 include a series of modular components which are assembled to draw the wellbore fluids and to displace them to the desired location. In the illustrated embodiment, the pumping systems each include an electric motor 30, such as a polyphase induction motor, a permanent magnet motor, or the like. The motor may include a sealed inner cavity which is flooded with a high quality mineral oil to provide desired cooling. A protector 32 is coupled to the motor to isolate the motor from wellbore fluids present in the annular region surrounding the pumping system. Protector 32 may include any suitable motor protector, such as those commercially available from REDA Pump of Bartlesville, Oklahoma, and including isolation components such as flexible bladders, labyrinth seals, and so forth. A submersible pump 34 is coupled to motor 30 through the intermediary of the protector 32, and is driven in rotation by the motor when energized. Other components, as indicated generally at reference numeral 36, may be included, such as for separating water or gas from liquid components such as petroleum, for reinjecting water or gas into desired discharge zones, and so forth.

The motor 30 of each pumping system receives electrical power and control signals, via a cable assembly 38. The cable assembly will typically be coupled to power and drive circuitry (not shown) above the earth's surface, which regulates the speed of the electric motor to provide the desired production rates. Where desired, the drive circuitry may afford controllable speeds, or fixed speeds. In the illustrated embodiment, each pumping system is deployed in the respective well by means of a length of conduit, such as coiled tubing 40. Coiled tubing 40 is coupled to the pumping system adjacent to a discharge side of pump 34, and receives flow from the pump during operation. In operation, fluid entering the wellbore through perforations 26 collects in the wellbore and is drawn into inlet openings 42 of pump 34. The pump then discharges the fluids through coiled tubing 40 through which the fluids rise to the well head 44. Above the well head 44 of each well, appropriate valving 46 is provided for regulating the flow of the fluids, diverting the flow, and so forth. Down stream of the valving 46 transfer conduits 48 direct the flow of production fluids to a manifold 50. Manifold 50 serves to collect and direct the flow from the various production wells into collection well 16 as described more fully below.

Those skilled in the art will note that the configuration of the production wells 12 and 14, and the foregoing description of the pumping systems 28 may be subject to a wide variety of modifications. For example, depending upon the well completion strategy and the location of the various production zones, the pumping system may include isolation packers, as well as various mandrills and subs for directing of flow and for isolating specific sections of the well from one another.

Collection well 16 is generally similar in configuration to production wells 12 and 14, but need not be provided with perforations 26 for independent production. Of course, where desired, such production may also be provided from collection well 16. In general, however, collection well 16 serves to receive produced fluids from the other wells of system 10 and acts as a reservoir for the fluids. Collection well 16 may be drilled for the express purpose of collecting the wellbore fluids from the other wells, or may be a well in a system of wells which is of lesser economic interest, or which has ceased to produce a useful volume of fluid. Where desired, collection well 16 may be a killed well in which fluids have been deposited to substantially interrupt flow from a subterranean production formation.

Fluids from production wells 12 and 14 are deposited in collection well 16 by means of an injection conduit 52 downstream of manifold 50. Conduit 52 may extend into well 16 to a point generally adjacent to an anticipated liquid level, or may terminate well above the liquid level. In the illustrated embodiment, fluids produced from wells 12 and 14 include liquid-phase components and gas-phase components which separate from one another in collection well 16, to form a generally liquid zone 54 and a gas zone 56. In practice, the particular gas content within the well will vary, as the gas-phase components are permitted to rise slowly in the liquid. A production pumping system 58 is provided within collection well 16 for transmitting the collecting liquid from the well to a production location. In the illustrated embodiment, the production pumping system 58 is generally similar to pumping systems 28 of the production wells, including a conduit or coiled tubing 60 from which the pumping system components are suspended. A cable assembly 62 extends from power and control circuitry (not shown) to provide power for driving the pumping system 58. The cable assembly may be provided within conduit 60 where sufficient space is available, or may be external to the conduit. The pumping system includes an electric motor 64 which is powered by electrical signals conveyed through the cable assembly. A motor protector 66 isolates the interior regions of the motor from the wellbore fluids as described above in the case of pumping systems 28. A pump 68 is driven by motor 64, through the intermediary of protector 66. Pump 68 includes an intake section 70 through which the liquid-phase components are drawn, and a discharge section 72 through which the pumped fluids are expressed. While various pumping system arrangements may be provided, in the illustrated embodiment, a shroud 74 serves to direct the pumped fluids from discharge section 72, around motor 64, to exit through conduit 60. As will be appreciated by those skilled in the art, other forms of pumping systems may be employed for this purpose, including pumping systems generally similar to those illustrated in the case of production wells 12 and 14 and described above.

Liquid-phase components produced by pumping system 58 are discharged from collection well 16 through a liquid production conduit 76. From conduit 76, the fluids may be conveyed to downstream valving, collection and processing equipment, and so forth (not shown). Gas separated from the liquid-phase components rises in the well and is produced through a gas production conduit 78. Downstream components may be provided for further processing of the gas, such as compressors, as indicated at reference numeral 80, pressure vessels, and so forth. In appropriate cases, the gas may be re-injected into desired regions of the well, burned, or otherwise disposed of.

It should be noted that the foregoing structure permits increased production from the production wells by significantly reducing the head which must be produced by the pumping systems 28 within production wells 12 and 14. Specifically, the production fluids need only be raised to the level of transfer conduits 48 and pumped through valving 46 and manifold 50 before being reinjected into collection well 16. Additional head required to force the production fluids to a final collection or processing location through liquid production conduit 76 is furnished by production pumping system 58 within collection well 16. It should also be noted that this fluid produced from the collection well will be of a substantially lower gas to oil ratio, thereby further improving efficiency of the overall system.

Figure 2:
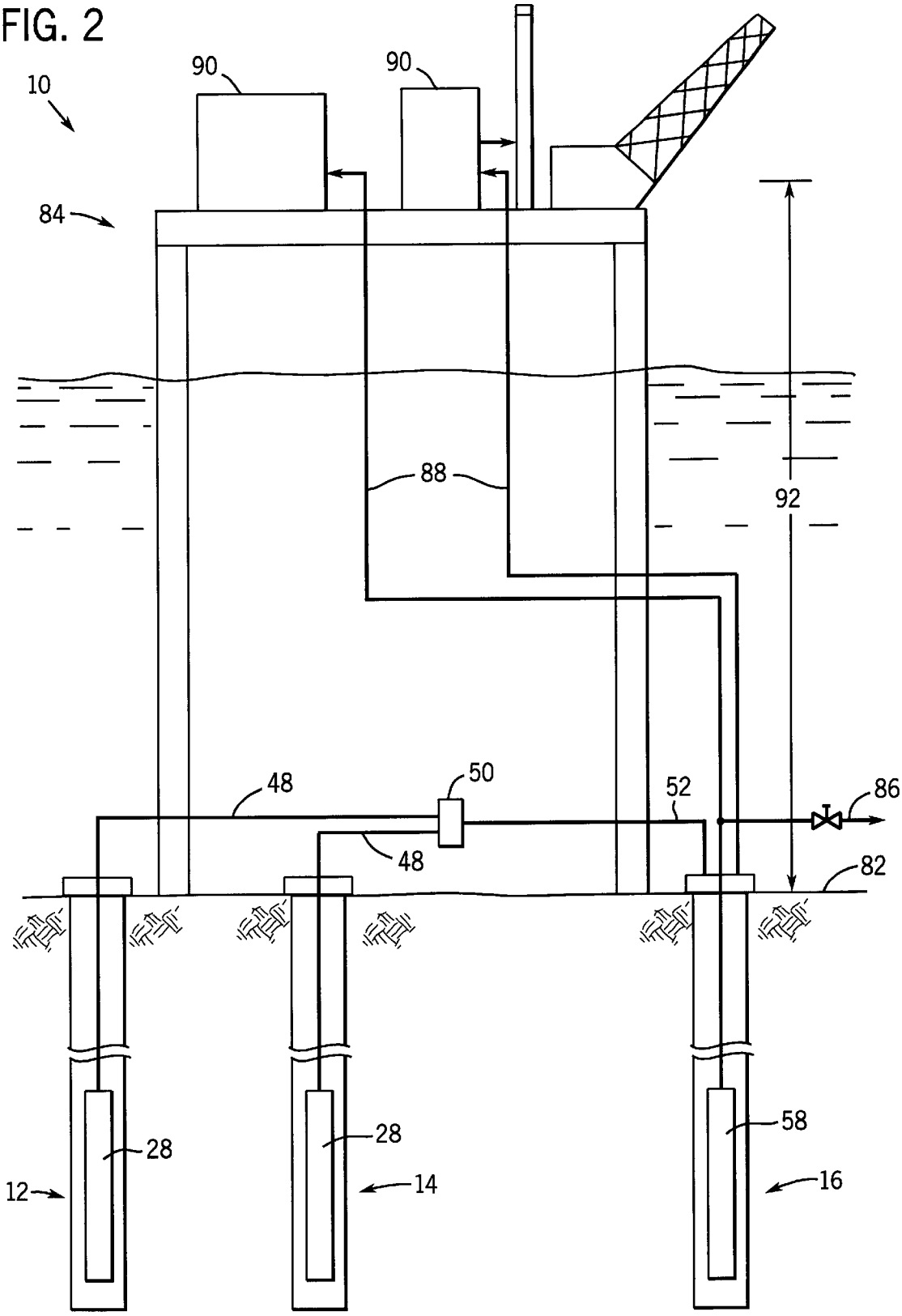
FIG. 2 is an elevational view of a system similar to that shown in FIG. 1, but implemented with a series of sub-sea wells.

The foregoing technique may be applied both in land-based production systems, as well as in sub-sea production. FIG. 2 illustrates diagramatically a series of production wells 12 and 14 provided in a system with a collection well 16 in a sub-sea application. In the embodiment shown in FIG. 2, rather than being disposed on dry land, the production and collection wells are formed through the sea bed as indicated at reference numeral 82. Production fluids are displaced from the production wells by pumping systems 28 as described above. The production fluids are transmitted, via transfer conduits 48 and one or more manifolds 50, to an injection conduit 52 through which the fluids are disposed in the collection well 16. Again, as described above, a production pumping system 58 displaces the liquid components, or substantially liquid components of the production fluids, from the collection well. In the embodiment illustrated in FIG. 2, flow discharged from pumping system 58 may be routed to a remote location via a transfer conduit 86, such as to a central production or storage vessel or platform, or to an on-shore location. Alternatively, the fluid may be directed upwardly through transfer conduits 88 to storage vessels 90 provided on a platform 84. In either event, the pumping systems provided within production wells 12 and 14 need only provide the head necessary to displace the fluids from the production wells to the collection well. Head required to move the fluids, or at least the liquid portions thereof, to the remote location through conduit 86 or conduits 88 is provided by pumping system 58. Thus, where collection vessels 90 are situated on a service platform in a marine location, the head required to raise the fluids to the collection vessels, as indicated at reference numeral 92, need not be provided by the pumping systems within the production wells, but is, instead, furnished by the collection well pumping system, thereby permitting the production well pumping systems to operate at an improved efficiency.

Figure 3:
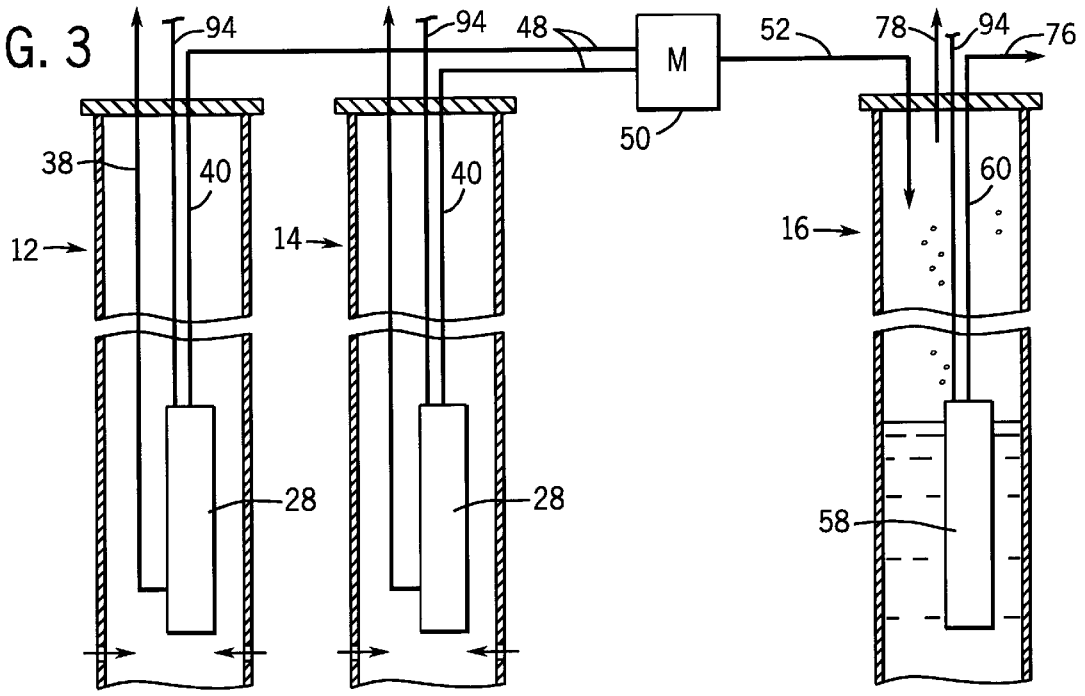
FIG. 3 is a diagrammatical representation of a system similar to that shown in FIGS. 1 and 2, but including submersible pumping systems suspended by cable assemblies in the respective wells.

In the foregoing embodiment, the pumping systems within the production and collection wells are deployed via a conduit, such as coiled tubing. However, in appropriate applications, the pumping systems may be deployed in any other suitable manner, such as via tension cables. FIG. 3 illustrates such an alternative embodiment. As shown in FIG. 3, pumping systems 28 in wells 12 and 14, as well as pumping system 58 in collection well 16, are suspended at desired locations within the respective well by a tension cable 94. As will be appreciated by those skilled in the art, such tension cables may be bound with power cables 38 used to supply electrical power to the pumping systems. In this embodiment, production fluids may rise through the wellbore casing using an appropriate packer (not shown), or may be channeled through conduits as described above.

Figure 4:
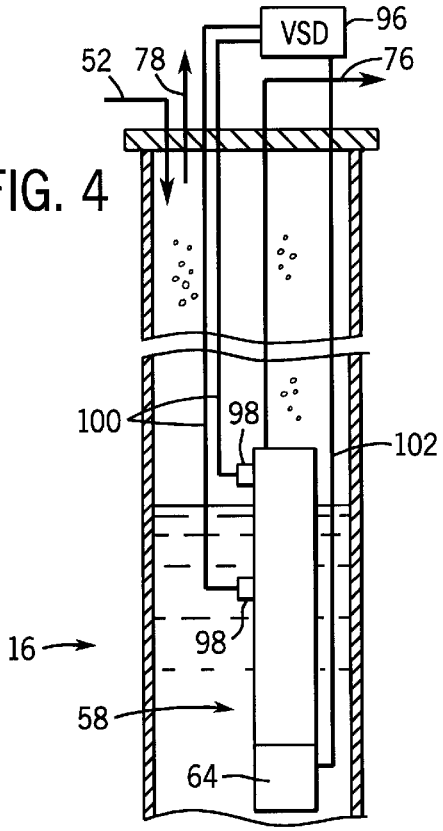
FIG. 4 is a diagrammatical elevational view of a collection well in which a submersible pumping system is instrumented and driven so as to regulate elevation of liquid-phase components therein.
Figure 5:
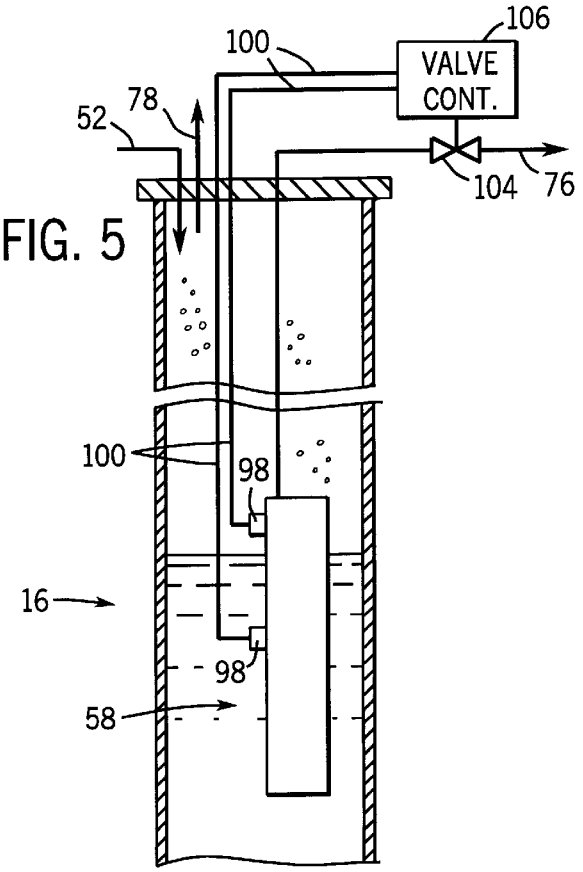
FIG. 5 is a view similar to that of FIG. 4, illustrating an alternative embodiment for a system designed to regulate the elevation of liquid phase components in a collection well.

The foregoing structure and technique is also adaptable for specific control, where appropriate, to maintain desired levels both within the production wells and within the collection well. In particular, it may be desirable to maintain specific elevations of fluid within the collection well to accommodate fluctuations in production from the production wells, and to provide desired residence times for the separation of gaseous and liquid phase components of the production fluids. FIGS. 4 and 5 illustrate exemplary configurations of systems adapted for this type of operation. Specifically, FIGS. 4 and 5 illustrate instrumentation provided on a pumping system 58 within a collection well 16 in systems of the type described above. In the embodiment of FIG. 4, a desired level is maintained in collection well 16 by feedback control of a variable speed drive 96 coupled to the motor 64 of the pumping system 58. The particular form of the variable speed drive 96 may vary, depending upon the type of motor employed. However, it is presently contemplated that any suitable variable speed drive may be used, such as pulse width modulated AC drives, pulse width modulated DC drives, variable voltage drives, and so forth. In general, the variable speed drive 96 receives input signals from level sensors 98 provided on pumping system 58. These level sensors may generally take the form of limit switches which convey signals to the variable speed drive via one or more instrumentation conductors 100. The variable speed drive then controls the operational speed of motor 64 through signals provided in a conductor 102. It should be noted that conductor 102 may be the same cables as those provided in cable assembly 40, such as in the case of variable frequency drives. The embodiment permits regulation of the speed of the pumping system which is based upon one or more levels sensed via sensors 98. Alternatively, the pumping system may be turned off and on as a function of the feedback signals. As a further alternative, analog or digital feedback signals may be provided and the speed of the system maintained to provide a relatively constant level of liquid in the collection well.

In the alternative configuration of FIG. 5, level sensors 98 convey feedback signals to a valve controller 106 which is coupled to a flow control valve 104 on production conduit 76. By regulating the flow through valve 104, controller 106 effectively regulates the rate at which fluid is extracted from the collection well and thereby the level of fluid in the well.

Figure 6:
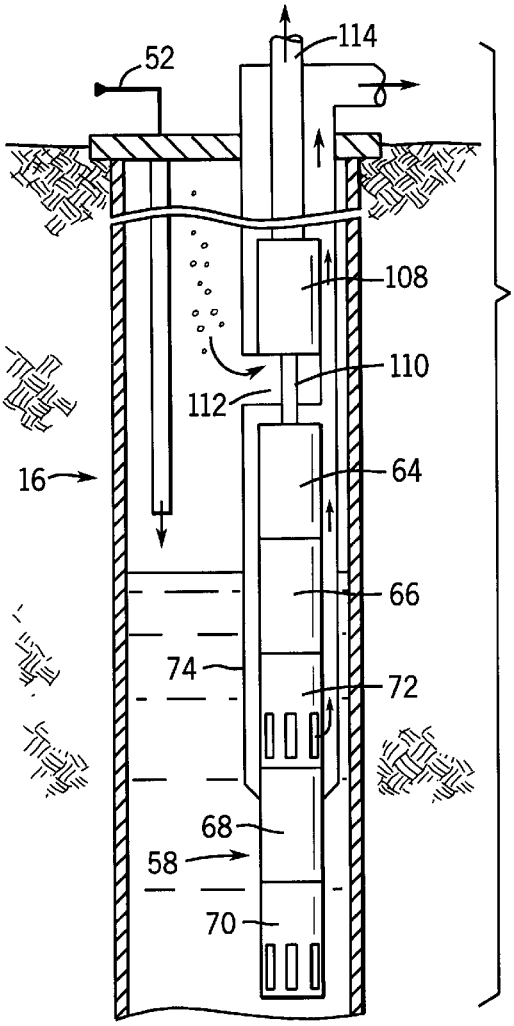
FIG. 6 is a diagrammatical elevational view of a further alternative configuration for a system designed to produce fluids from a collection well, including a gas compressor.

Other variance on the foregoing structure and technique may be envisaged by those skilled in the art. For example, rather than producing gas through the annulus of collection well 16, the pumping system deployed in the collection well may include an integral compressor for compressing and displacing the gas. As shown in FIG. 6, a gas compressor 108 may be installed as an integral modular component of pumping system 58. The compressor may be driven by motor 64, as shown in FIG. 6, or by separate drive means. In the illustrated embodiment, a transmission shaft 110 conveys mechanical power from the motor to compressor 108. An inlet 112 is provided in the conduit partially surrounding the pumping system to permit the intake of gas from the upper region of the collection well. The gas is compressed by compressor 108 and is discharged from the well through a conduit 114 which, as illustrated, may be provided coaxially with the conduit through which the liquid-phase components are produced.

Figure 7:
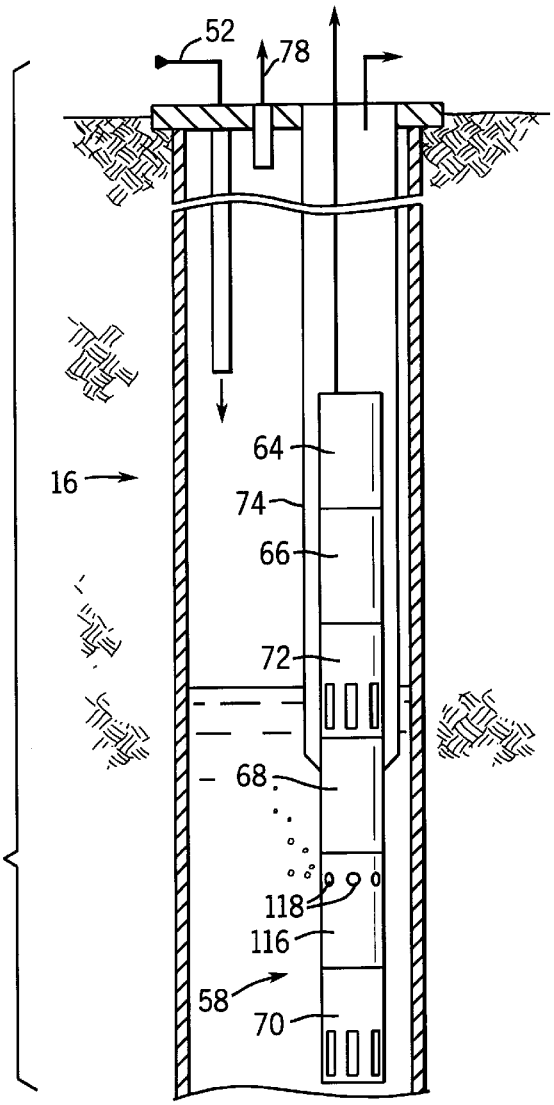
FIG. 7 is a diagrammatical elevational view of a further alternative configuration of a submersible pumping system in a collection well, including a mechanical or similar separator for separating gas-phase components of the collected fluids from liquid-phase components.

In a further alternative embodiment, where the gravity separation of gaseous and liquid-phase components is slower than desired (such as due to fluid viscosity, production rates, residence time in the collection well, and so forth), a mechanical separation device may be provided in pumping system 58. FIG. 7 illustrates an arrangement of this type, wherein the pumping system 58 includes a rotary separator 116 for at least partially removing gaseous components of the wellbore fluids were deposited within well 16. In the illustrated embodiment, separator 116 is positioned between pump 68 and intake section 70. Fluids drawn into intake section 70 are processed within separator 116 to remove the gaseous components which exit form the separator through discharge apertures 118. From this point, the gases may be permitted to rise to a higher level in the collection well by virtue of their low specific gravity or may be directed to a desired location via a gas conduit (not shown). Moreover, separator 116 may include any suitable type of separation device, such as centrifugal separators, hydrocyclone separators, and so forth.

Figure 8:
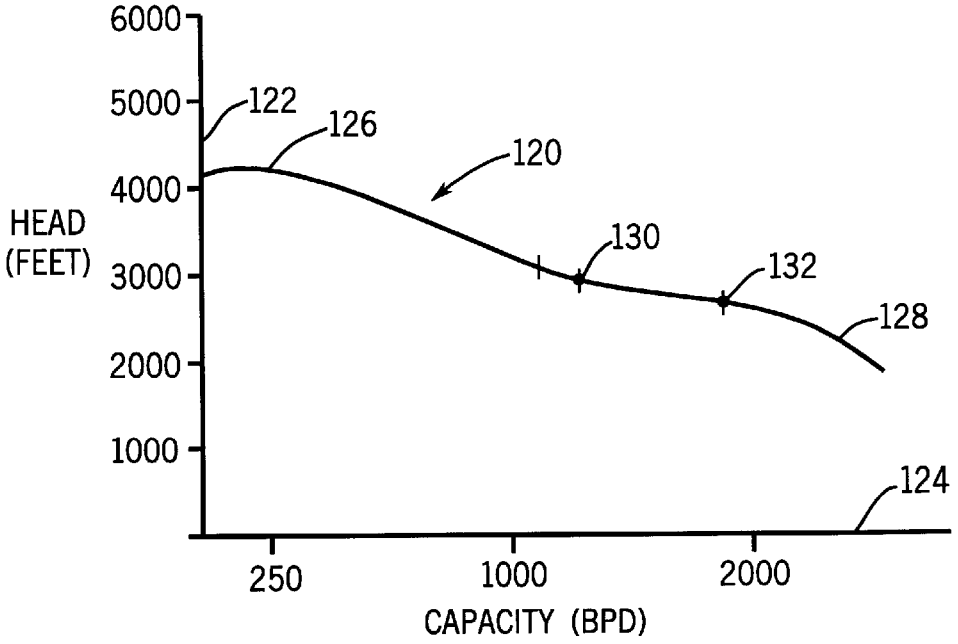
FIG. 8 is a graphical representation of a typical pump curve illustrating production capacity of a submersible pumping system of the type shown in the previous figures as a function of head.

As summarized above, the foregoing technique affords improved production from the entire system of wells by virtue of the reduced head demands on the pumping systems 28 within the production wells 12 and 14. FIG. 8 illustrates graphically a typical curve for a multi-stage centrifugal pump in a pumping system of the type employed in submersible applications. The pump curve, designated 120 in FIG. 8, identifies the relationship between the head, as indicated on axis 122, and the flow rate or capacity of the pumping system (typically expressed in units of barrels per day) along horizontal axis 124. As can be seen in FIG. 8, curve 120 declines from a left hand level 126 downward to the right as it approaches lower extremity 128. Thus, as the output head or demands on the pumping system increase, the capacity of the system declines sharply. By way of example, reference numeral 130 represents a location on the curve corresponding approximately to 3,000 feet of head, and a capacity of approximately 1,200 barrels per day. If the same system is permitted to operate at a reduced head, such as approximately 2,800 feet, as indicated at reference numeral 132, production increases to approximately 1,800 barrels per day. Thus, by requiring that the pumping systems within the production wells only displace fluid to the collection well, and not to the final collection or processing point, the pumping systems may operate at a greatly enhanced capacity.

Figure 9:
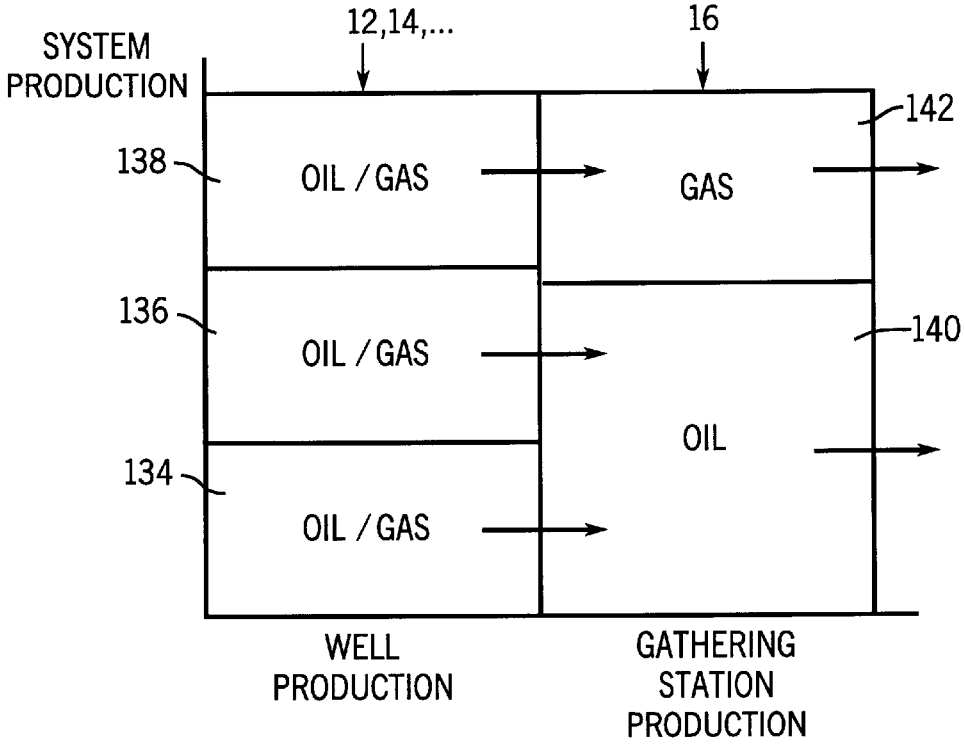
FIG. 9 is a diagrammatical representation of exemplary production volumes from a series of production wells and then from a collection or gathering well into which the fluids from the production wells are injected.

Also, as discussed above, where the production fluids include substantial quantities of gas, the foregoing technique permits the production fluids to be displaced in a rapid and efficient manner from the production wells, with the gas being separated later in the collection well. As indicated in FIG. 9, in an exemplary embodiment, three production wells provided in such a system may produce different levels of oil and gas, as indicated by reference numerals 134, 136 and 138. Moreover, the particular gas to oil ratio of each production well may vary over time and there may be substantial variations between the levels of gas in the production fluids between the various wells. The production from each well is deposited in a gathering or collection well 16, where the gas is allowed or forced to separate from the liquid components. As a result, the pumping system within the collection well, where desired, need only produce the liquid phase components as indicated at reference numeral 140, and not the additional volume of gas as indicated at reference numeral 142. This aspect of the technique illustrates the ability to provide a pumping system in the collection well which is of a relatively lower capacity than the apparent total capacity of the production wells.

Various alternative arrangements may be envisaged for the foregoing structure and technique, particularly regarding the types of fluid displacement systems provided in the various wells. In particular, as mentioned above, the means for lifting fluids from the production wells, and for displacing the fluids from the collection or gathering well may take various forms, depending upon the locations of the wells, the well conditions, the types of fluids being produced, and so forth. Thus, while in the foregoing embodiments fully submergible pumping systems are described, the production wells may raise fluids by any suitable means, including gas lift, sucker rod pumps, under natural pressures, as well as via pumping systems incorporating centrifugal pumps, progressive cavity pumps, jet pumps, and so forth. As will be appreciated by those skilled in the art, the technique may provide enhanced benefits where systems such as gas lift, jet pumps and natural pressures are employed to raise production fluids, such systems being particularly sensitive to well head pressures. Similarly, any suitable means may be provided in the gathering or collection well for raising the collected fluids. In general, artificial lift means will be preferred for this purpose.

What is claimed is:

1. A system for producing fluids from wells the system comprising:

a first submergible pumping system disposed in a first well for displacing fluids from the first well to a second well;

a fluids transfer assembly configured for conveying the fluids displaced by the first submergible pumping system to the second well, wherein the fluids conveyed into the second well include aaseous and liquid phase components;

a second submergible pumping system disposed in the second well for displacing at least a portion of the fluids to a collection location, wherein the second submergible pumping system is disposed within a portion of the second well in which liquid phase components collect during operation of the system; and a flow control assembly configured for controlling a liquid level in the second well, wherein the flow control assembly comprises a sensor coupled to a variable speed drive, the variable speed drive regulating a rate of liquid displacement of the second submergible pumping system to maintain a desired level of liquid in the second well.

2. The system of claim 1, further comprising a gas transfer assembly configured for conveying gaseous phase components from the second well to a collection location.

3. The system of claim 1, comprising a plurality of first submergible pumping systems disposed in respective first wells and wherein the fluids transfer assembly is configured for transferring fluid from the plurality of first wells to the second well.

4. The system of claim 1, comprising a separator assembly configured for at least partially separating the gaseous and liquid phase components.

5. The system of claim 4, wherein the separator assembly comprises the second well, which is configured to at least partially utilize gravity to separate the gaseous and liquid phase components.

6. The system of claim 1, wherein the first and second submergible pumping systems are disposed at a subsea location.

7. The system of claim 6, wherein the second submergible pumping system displaces fluids from the second well to a location above a body of water overlying the first and second wells.

8. A system for producing fluids from wells, the system comprising:

a first submergible pumping system disposed in a first well for displacing fluids from the first well to a second well;

means for conveying the fluids displaced by the first submersible pumping system to the second well, wherein the fluids conveyed into the second well include gaseous and liquid phase components;

a second submergible pumping system disposed in the second well for displacing at least a portion of the fluids to a collection location, wherein the second submergible pumping system is disposed within a portion of the second well in which liquid phase components collect during operation of the system; and means for automatically controlling a liquid level in the second well, wherein the means for automatically controlling the liquid level includes at least one level sensor, a control valve and a control circuit for regulating output from the second submergible pumping system.

9. The system of claim 8, further comprising a gas transfer assembly configured for conveying gaseous phase components from the second well to a collection location.

10. The system of claim 8, comprising a plurality of first submergible pumping systems disposed in respective first wells and wherein the means for conveying the fluids transfers fluid from the plurality of first wells to the second well.

11. The system of claim 8, comprising a separator assembly configured for at least partially separating the gaseous and liquid phase components.

12. The system of claim 11, wherein the separator assembly comprises the second well, which is configured to at least partially utilize gravity to separate the gaseous and liquid phase components.

13. A method for producing fluid from a plurality of wells, the method comprising:

(a) pumping fluid from a plurality of production wells to a collection well, comprising positioning a submergible pumping system in at least one of the plurality of production wells to force fluid through a transfer conduit to the collection well;

(b) injecting the fluid into the collection well; and (c) displacing at least a portion of the fluid from the collection well to a location remote from the collection well.

14. The method of claim 13, comprising at least partially separating first and second substances of the fluid.

15. The method of claim 14, wherein the first substance comprises liquid phase components and the second substance comprises gaseous phase components, and the act of separating first and second substances comprises at least partially utilizing gravity in the collection well.

16. The method of claim 14, wherein the act of separating first and second substances comprises driving a separator assembly in the collection well.

17. The method of claim 13, comprising controlling a flow rate from the collection well to regulate a level of fluids in the collection well.

18. method for producing fluid from a plurality of wells, the method comprising:

(a) pumping fluid from a plurality of production wells to a collection well, comprising displacing liquid and gaseous components from at least one of the production wells to the collection well;

(b) injecting the fluid into the collection well;

(c) separating liquid phase components from gaseous phase components in the collection well;

(d) displacing at least a portion of the fluid from the collection well to a location remote from the collection well.

19. The method of claim 18, comprising controlling a flow rate from the collection well to regulate a level of fluids in the collection well.

20. The method of claim 18, wherein the liquid phase components are separated from the gaseous phase components in the collection well via gravity.

21. The method of claim 18, wherein the liquid phase components are separated from the gaseous phase components in the collection well via a separator driven in the collection well.

22. A method for producing fluid from a plurality of wells, the method comprising:

(a) pumping fluid from a plurality of production wells to a collection well;

(b) injecting the fluid into the collection well; and (c) displacing at least a portion of the fluid from the collection well to a location remote from the collection well, comprising controlling a flow rate from the collection well to regulate a level of fluids in the collection well, wherein the flow rate is controlled by a variable speed drive coupled to an electric motor of a submergible pumping system disposed in the collection well.

23. The method of claim 22, comprising at least partially separating first and second substances of the fluid.

24. The method of claim 23, wherein the first substance comprises liquid phase components and the second substance comprises gaseous phase components, and the act of separating first and second substances comprises at least partially utilizing gravity in the collection well.

25. The method of claim 23, wherein the act of separating first and second substances comprises driving a separator assembly in the collection well.

26. A method for separating and producing fluids from a plurality of wells, the method comprising the steps of:

(a) displacing liquid and gaseous phase components of wellbore fluids from a plurality of production wells;

(b) depositing the fluids in a collection well;

(c) at least partially separating the liquid and gaseous phase components in the collection well; and (d) displacing at least a portion of the fluids from the collection well, comprising controlling a flow rate from the collection well to regulate a level of fluids in the collection well wherein the flow rate is controlled by a variable speed drive coupled to an electric motor of a submergible pumping system disposed in the collection well.

27. The method of claim 26, wherein the act of separating the liquid and gaseous phase components comprises at least partially utilizing gravity in the collection well.

28. The method of claim 26, wherein the act of separating the liquid and gaseous phase components comprises driving a separator assembly in the collection well.

* * * * *